US012044095B2

(12) United States Patent
Eldho et al.

(10) Patent No.: US 12,044,095 B2
(45) Date of Patent: Jul. 23, 2024

(54) PACKER SYSTEM WITH A SPRING AND RATCHET MECHANISM FOR WELLBORE OPERATIONS

(71) Applicant: Halliburton Energy Services, Inc., Houston, TX (US)

(72) Inventors: Shanu Thottungal Eldho, Singapore (SG); Balaji Prasad Jutu Mothilal, Singapore (SG); Jalpan Piyush Dave, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/702,062

(22) Filed: Mar. 23, 2022

(65) Prior Publication Data

US 2023/0304374 A1 Sep. 28, 2023

(51) Int. Cl.
*E21B 33/129* (2006.01)
*E21B 23/06* (2006.01)

(52) U.S. Cl.
CPC ..... *E21B 33/1293* (2013.01); *E21B 23/06* (2013.01)

(58) Field of Classification Search
CPC ..... E21B 33/1285; E21B 33/1293; E21B 23/06
See application file for complete search history.

(56) References Cited

U.S. PATENT DOCUMENTS 2,620,036 A * 12/1952 Morgan ..... E21B 33/1294 166/130
4,224,987 A * 9/1980 Allen ..... E21B 33/1295 166/120
4,444,252 A 4/1984 Fisher, Jr.
5,117,906 A 6/1992 Giusti, Jr. et al.
5,749,585 A * 5/1998 Lembcke ..... E21B 33/128 166/217
6,902,008 B2 6/2005 Hirth et al.
(Continued)

FOREIGN PATENT DOCUMENTS

CN 113338841 A 9/2021
GB 2316699 A * 3/1998 ..... E21B 33/1295
WO 2008021703 A1 2/2008

OTHER PUBLICATIONS

Halliburton Energy Services, Inc., International Search Report and Written Opinion, PCT/US2022/021508. Dec. 16, 2022, 9 pages.

*Primary Examiner* — D. Andrews
*Assistant Examiner* — Ronald R Runyan
(74) *Attorney, Agent, or Firm* — Kilpatrick Townsend & Stockton LLP

(57) ABSTRACT

A packer system includes a retainer positionable adjacent to a packing element and coupleable to a cylinder of a downhole tool in a wellbore. The retainer is moveable in a first direction along a mandrel of the downhole tool to compress the packing element to a compressed state and generate a seal in the wellbore or to set a slip in response to an applied pressure. The packer system includes a piston moveable in a second direction along the mandrel and configured to compress a spring in response to the applied pressure. The packer system includes an interfacing element configured to couple the cylinder to the piston subsequent to the cylinder moving a predefined amount. The packer system includes a ratchet mechanism configured to prevent movement of the cylinder in the second direction.

20 Claims, 6 Drawing Sheets

(56) References Cited

U.S. PATENT DOCUMENTS

| | | | | |
|---|---|---|---|---|
| 8,881,836 | B2 | 11/2014 | Ingram | |
| 10,590,732 | B2 | 3/2020 | Ingram | |
| 2016/0115762 | A1 | 4/2016 | O'Dwyer et al. | |
| 2018/0252074 | A1 | 9/2018 | Hughes et al. | |
| 2019/0093449 | A1* | 3/2019 | Sanchez | E21B 33/1285 |

* cited by examiner

PACKER SYSTEM WITH A SPRING AND RATCHET MECHANISM FOR WELLBORE OPERATIONS

TECHNICAL FIELD

The present disclosure relates generally to wellbore operations and, more particularly (although not necessarily exclusively), to packer systems in wellbores.

BACKGROUND

Packers may be used for, among other reasons, forming annular seals in and around conduits in wellbore environments. The packers may be used to form these annular seals in both open and cased wellbores. The annular seals may restrict portions of fluid or pressure communication at a seal interface. Forming seals may be part of wellbore operations at stages of drilling, completion, or production. The packers may be used for zonal isolation in which a zone or zones of a subterranean formation may be isolated from other zones of the subterranean formation or other subterranean formations. One use of packers may be to isolate any of a variety of inflow control devices, screens, or other such downhole tools that may be used in wellbores.

DETAILED DESCRIPTION

Figure 1:
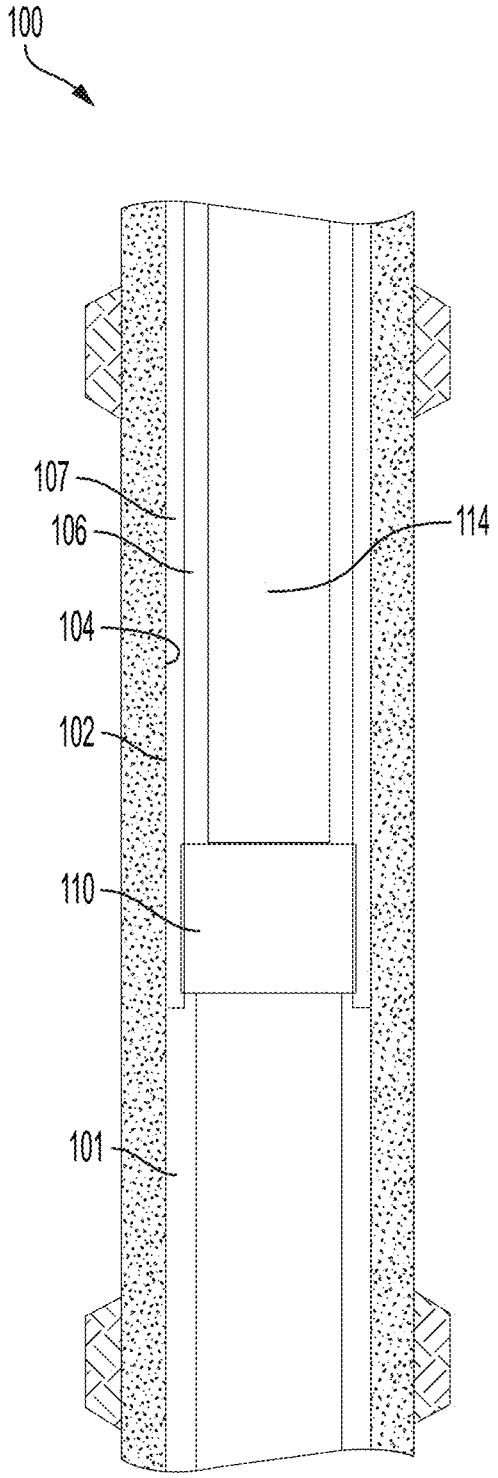
FIG. 1 is a schematic of a well system that can use a packer system with a spring and a ratchet mechanism in a subterranean formation according to one example of the present disclosure.

Certain aspects and examples of the present disclosure relate to packer system with a spring and a ratchet mechanism. The packer system may be deployed in a wellbore for isolating zones within a wellbore during downhole operations. Examples of the downhole operations may be hydraulic fracturing or completion operations. The packer system can include a packing element that can be compressed to form a seal in the wellbore to isolate the zones of the wellbore. A first cylinder of the packer system be coupled to a second cylinder, and the first cylinder and the second cylinder can move in a first direction based on pressure applied to the packer system, causing the second cylinder to engage with and compress the packing element. A ratchet mechanism of the packer system, which is coupled to the first cylinder, can prevent backward movement of the first cylinder and the second cylinder to lock in the setting force.

A piston of the packer system can simultaneously move in a second direction based on the applied pressure to compress a spring.

Upon the spring being compressed and the first cylinder moving a predefined amount, an interfacing element, such as a snap ring, can couple the piston to the first cylinder and the second cylinder. So, if the packing element compresses further, for example, as a result of downhole conditions changing, energy stored in the compressed spring can be transferred to the piston, the interfacing element, the first cylinder, the second cylinder, and the retainer. Thus, contact and force can be maintained on the packing element as natural changes occur to the packing element.

As an example, when a hydraulically set packer has been set at high temperatures, the packing element may have trouble sealing a wellbore in colder temperatures. In cold temperatures, the element package contracts, introducing a slop, or gap, inside the packing element. The slop can lead to a reduction in squeeze applied to the packing element, thereby reducing the contact pressure with the mandrel and a casing, or open hole, in a wellbore. Thus, the packing element can lose part of its ability to hold a desired differential pressure, which may be an issue in applications where the temperature swing is large or the setting force is limited. As an example, a large temperature swing may be from 350° F. to 50° F.

Aspects of the present disclosure relate to a packer system that can automatically maintain the squeeze on the element packages in large temperature swings, after a large number of pressure reversals on the element packages, or when the setting force is limited. In a run configuration, as the packer system is positioned downhole in a wellbore, a first cylinder and second cylinder can be coupled together and coupled to an anti-preset mechanism, which can prevent a retainer coupled to the second cylinder from moving. Hydraulic pressure can be applied through ports of a mandrel of the packer system to disengage the anti-preset mechanism. The pressure acts on the retainer and the piston and pushes the first and second cylinders to compress and set the packing element. The first and second cylinders can be coupled to the mandrel by a ratcheting mechanism, which can prevent any backward movement of the first and second cylinders. The pressure can also push on the piston and compress a spring. Examples of the spring include a beam spring, a wave spring, a disc spring, a helical spring, or a hybrid. The first and second cylinders may move in a first direction while the piston moves in a second direction. Towards an end of a setting process for the packer system, a groove on the second cylinder can engage with an interfacing element, such as an outward biased snap ring on the piston.

Once the hydraulic pressure is bled off after the setting process, force from the spring can be transferred into the second cylinder through the piston, and hence into the packing element. During a temperature swing from hot to cold when the packing element may shrink, the energy from the spring can push the piston in the first direction, which in turn can push the first and second cylinders in the first direction. The movement of the first and second cylinders can ratchet a body lock ring of a ratchet mechanism and compress the packing element, thus maintaining the squeeze on the packing element and preventing slop from being introduced inside the packing element.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 that can use a packer system with a spring and a ratchet mechanism in a subterranean formation 104 according to one example of the present disclosure. The well system 100 can include a wellbore 102 extending through various earth strata. The wellbore 102 can extend through a subterranean formation 104 that can include hydrocarbon material such as oil, gas, coal, or other suitable material. In some examples, a tubing string 106 can extend from a well surface into the subterranean formation 104. Fluids, such as solids-control fluids and production fluids produced from the subterranean formation 104 can flow through a packer and into the tubing string 106 to travel to the well surface. In some examples, a casing string 107 can be run from a well to protect the formation against damage. The casing string 107 can be coupled to walls of the wellbore 102 via cement or other suitable coupling material. For example, a cement sheath can be positioned or formed between the casing string 107 and the walls of the wellbore 102 for coupling the casing string 107 to the wellbore 102. The casing string 107 can be coupled to the wellbore 102 using other suitable techniques. In some examples, the wellbore 102 may not include the casing string 107 (e.g., or the cement sheath), and, instead, a wall of the wellbore 102, or a portion thereof, may be or otherwise include the subterranean formation 104.

The well system 100 can include at least one well tool 110 that can be positioned in the wellbore 102. The well tool 110 can be coupled to a wireline 114, a slickline, or coiled tubing that can be deployed into the wellbore 102. The wireline 114, the slickline, or the coiled tube can be guided into the wellbore 102 using, for example, a guide or winch. In some examples, the wireline 114, the slickline, or the coiled tube can be unwound from around a reel to be deployed into the wellbore 102. In some examples, the well tool 110 can be a packer or other suitable well tool that can be used to isolate one or more intervals of the wellbore 102 such as interval 101. The well tool 110 can expand radially outward, actuate, or otherwise perform suitable tasks for isolating the interval 101 of the wellbore 102 from other portions of the wellbore 102.

The interval 101 of the wellbore can include a subset of the wellbore 102. A wall of the wellbore 102 in the interval 101 can include a casing string 106 having perforations (e.g., for hydraulic fracturing or other similar wellbore operations) for accessing the subterranean formation 104. In some examples, the wall of the wellbore 102 in the interval 101 can alternatively be or otherwise include the subterranean formation 104 (e.g., the interval 101 may not include a casing string 106 or other similar component positioned in the wellbore 102). The interval 101 can be isolated (e.g., using the well tool 110) for performing one or more wellbore operations. For example, the interval 101 can be isolated for performing stimulation operations, for injecting solids-control fluids into the subterranean formation 104 for controlling flow of solids, such as sand, fines, or other suitable solids, in the subterranean formation 104, or for performing other suitable wellbore operations.

Figure 2A:
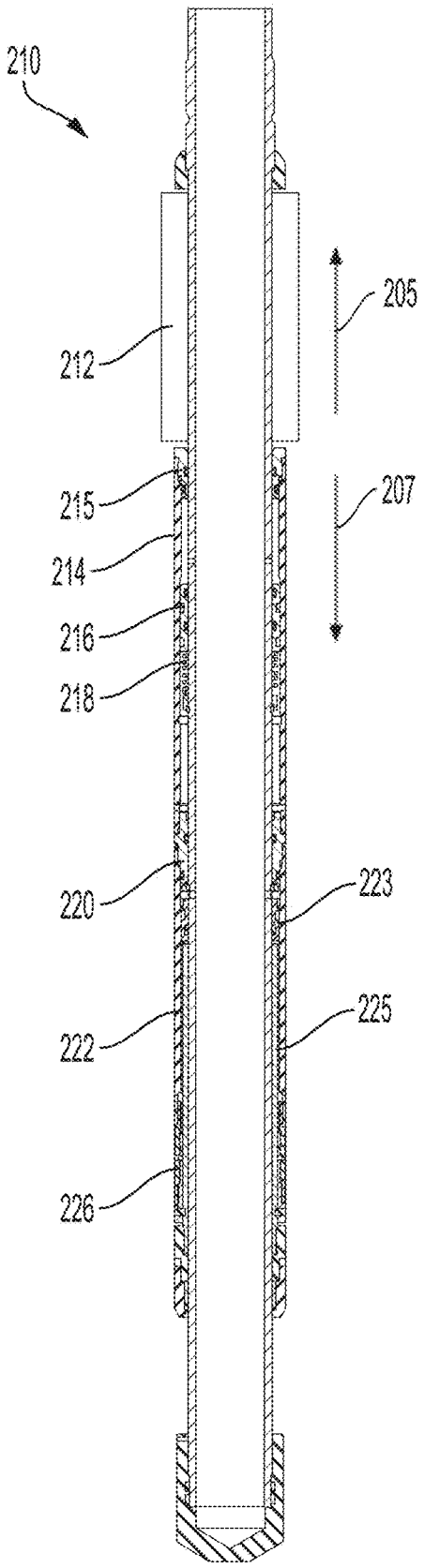
FIGS. 2A-2B are cross-sectional views of a packer system with a spring and a ratchet mechanism in a run configuration according to one example of the present disclosure.
Figure 2B:
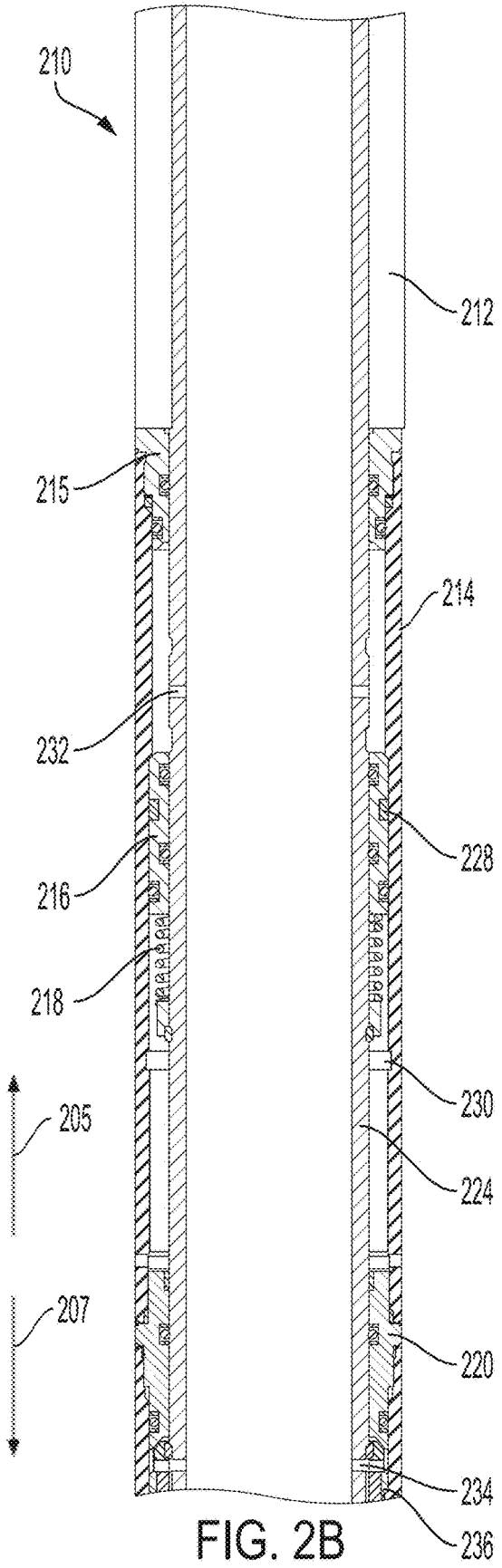

FIGS. 2A-2B are cross-sectional views of a packer system 210 with a spring 218 and a ratchet mechanism 226 in a run configuration according to one example of the present disclosure. The packer system 210 can be a downhole tool, such as well tool 110 in FIG. 1. The packer system 210 can include a packing element 212, a first piston 223, a second piston 216, a spring 218, a first cylinder 222, a second cylinder 214, a ratchet mechanism 226, an interfacing element 228, and an anti-preset mechanism 236 positioned around a mandrel 224. In a dual-piston configuration, which is shown in FIGS. 2A-2B, the packer system 210 can include an adapter 220 that couples the first cylinder 222 and the second cylinder 214. A first end of the second cylinder 214 can be coupled to a retainer 215. The retainer 215 may be a separate component, or may be integrally formed with the second cylinder 214. A second end of the second cylinder 214 can be coupled to the first cylinder 222 by an adapter 220. The first cylinder 222 can be coupled to the mandrel 224 through a ratchet mechanism 226. In FIGS. 2A-2B, the first cylinder 222 is coupled to an intermediate mandrel 225, which in turn is coupled with the mandrel 224. A portion of the second cylinder 214 that extends between the first end and the second end can encapsulate the second piston 216 and the spring 218. The spring 218 may be a beam spring, a helical spring, or a hybrid. In a single-piston configuration, the packer system 210 can exclude the first piston 223, and can include a single cylinder extending from the retainer to the ratchet mechanism 226.

The retainer 215 can be in contact and engage with the packing element 212. In the run configuration, the packing element 212 can be in an extended state as the mandrel 224 is run downhole into a wellbore. In an example, the packing element 212 can include an elastomeric sealing element surrounded by metal-backup shoes. The elastomeric sealing element may be any polymer-based material, rubber-based material, or any other suitable material for receiving a force, such as an axial load, to compress into a compressed state form a seal against the wellbore. The packing element 212 may be compressed between the retainer 215 and an end ring 211, which can be coupled to the mandrel 224 by a set screw or threads. Although the figures are described with respect to a packing element, other examples may alternatively include a slip that can be positioned in an engaged state that bites into the casing or open hole of the wellbore in response to an applied pressure.

In some examples, once the mandrel 224 is run downhole, a pressure can be received through ports of the mandrel 224. For example, the mandrel 224 can include a first port 232 between the retainer 215 and the second piston 216 in the run configuration. The mandrel 224 can also include a second port 234 between the adapter 220 and the first piston 223. The pressure within the mandrel 224 can be controlled from a surface of the wellbore. The pressure inside the first port 232 can drive the second piston 216 in direction 207 and compress the spring 218. The second piston 216 may be connected to the mandrel 224 using a shear screw, and the pressure can shear the shear screw prior to moving the second piston 216. The pressure can also act on the retainer 215 and can drive the retainer 215 in direction 205 to apply an axial load as a seal-setting force on the packing element 212. Direction 205 can be an uphole direction and direction 207 can be a downhole direction or vice versa. Simultaneously, the pressure applied through the second port 234 can disengage the anti-preset mechanism 236 that prevents the first cylinder 222, the second cylinder 214, and the retainer 215 from moving in direction 205 and compressing the packing element 212. In some examples, the anti-preset mechanism 236 may be a shear screw that shears when a specified amount of force is applied to the shear screw. In such an example, the retainer 215 moves in direction 205 and applies the seal-setting force on the packing element 212 when the shear screw is sheared in response to the pressure.

The retainer 215 can move in direction 205 to compress the packing element 212 while the second piston 216 moves in direction 207 to compress the spring 218. Once the spring 218 is compressed a predefined amount, an interfacing element 228 can couple the second cylinder 214 to the second piston 216. As an example, the interfacing element 228 may be a snap ring that initially sits within a channel of the second piston 216. The snap ring can expand and engage with a groove 230 of the second cylinder 214 when the spring 218 is compressed the predefined amount. In some examples, the predefined amount can correspond to an amount in direction 205 in which the retainer 215 and the first cylinder 222 move to set the packing element 212 and seal the wellbore.

In some examples, the first cylinder 222 moving in direction 205 can cause ratcheting of the ratchet mechanism 226, which is further described in FIG. 4. The ratchet mechanism 226 can prevent movement of the first cylinder 222 and the second cylinder 214 in direction 207. So, as the first cylinder 222 and the second cylinder 214 move in direction 205 to compress the packing element 212, the ratchet mechanism 226 ratchets, preventing the first cylinder 222 and the second cylinder 214 from moving in direction 207 and returning to their original positions.

While the second cylinder 214 in FIGS. 2A-2B is illustrated as including one groove, other examples may include multiple grooves. The interfacing element 228 can be machined with an angle so that the interfacing element 228, once expanded into a first groove, can be pushed back into the channel as the retainer 215 may need to travel a larger distance to fully compress the packing element 212. So, the first cylinder 222 can travel until a desired groove is reached. Once the interfacing element 228 reaches the second groove, the interfacing element 228 can fit into the second groove to couple the second piston 216 with the second cylinder 214. As previously described, the second piston 216 can couple with any groove on the first cylinder 222 until the spring 218 is fully compressed.

Figure 3A:
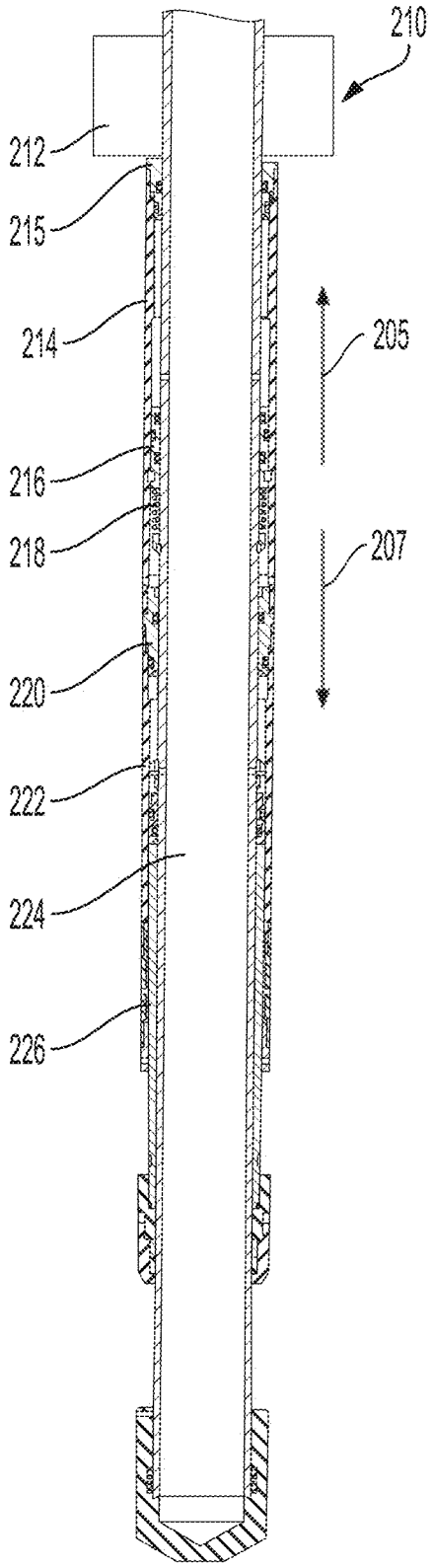
FIGS. 3A-3B are cross-sectional views of a packer system with a spring and a ratchet mechanism in a set configuration according to one example of the present disclosure.
Figure 3B:
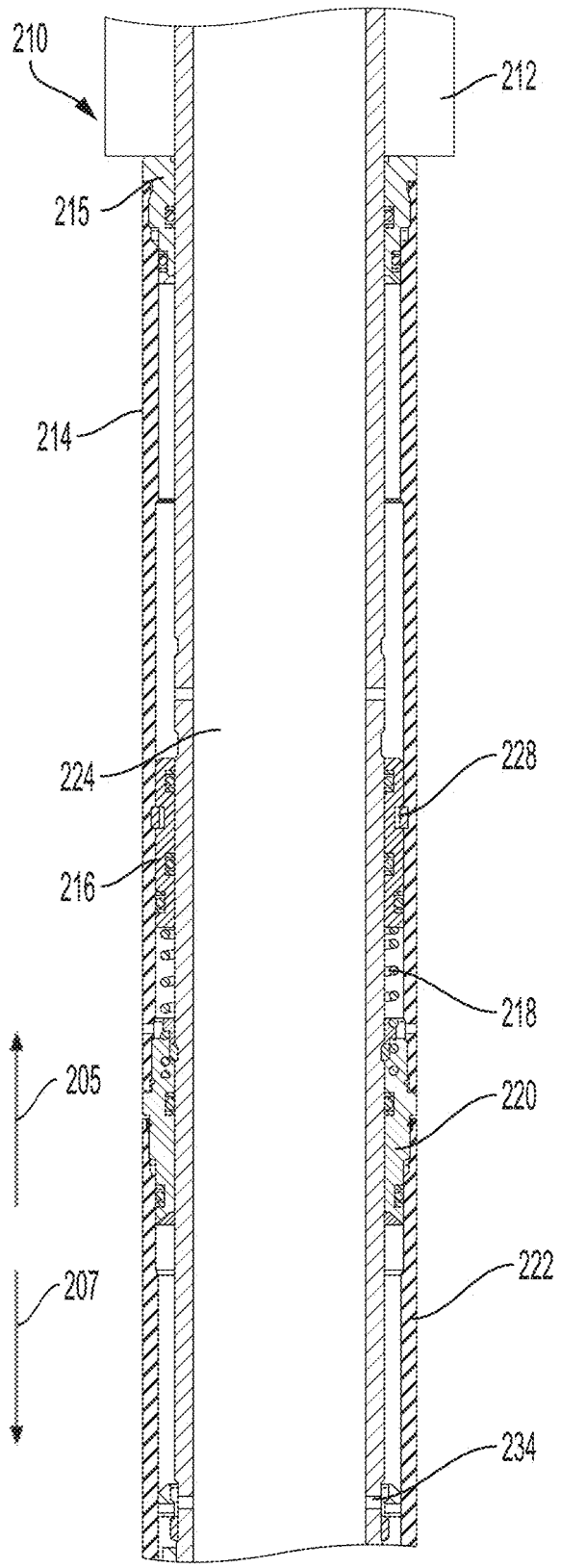

FIGS. 3A-3B are cross-sectional views of the packer system 210 in a set configuration according to one example of the present disclosure. The packer system 210 can be considered to be in the set configuration when the packing element 212 is in the compressed state and forms the seal in the wellbore, and the spring 218 is compressed the predefined amount so that the interfacing element 228 couples the second piston 216 to the second cylinder 214. As an example, the set configuration may occur when there is a distance of nine inches between the retainer 215 and the end ring shown in FIG. 2A. With the interfacing element 228 coupling the second piston 216 to the second cylinder 214, a spring force of the spring 218 wanting to expand from being compressed can push on the second piston 216. The spring force can be transferred to the second cylinder 214 through the interfacing element 228. If the packing element 212 is compressed to form the seal with the wellbore and the retainer 215 is in contact with the packing element 212, the retainer 215, the second piston 216, the first cylinder 222, the second cylinder 214, and the interfacing element 228 can be energized by the spring 218 in case the packing element 212 compresses beyond the initial compressed state.

In some examples, when the packing element 212 is in the compressed state, downhole conditions of the wellbore may cause the packing element 212 to further compress. For example, the packing element 212 may shrink during temperature swings from hot to cold. Without the retainer 215, the second piston 216, the first cylinder 222, the second cylinder 214, and the interfacing element 228 being energized by the spring 218, the further compression of the packing element 212 from a first compressed state to a second compressed state may leave a gap between the retainer 215 and the packing element 212. As a result, the packer system 210 may not properly seal the wellbore. But, the energy from the spring 218 expanding can push the second piston 216 in direction 205, which in turn can push the first cylinder 222, the second cylinder 214, and the retainer 215 in direction 205. The movement of the retainer 215 in direction 205 can ensure that the retainer 215 maintains contact with the packing element 212, thus eliminating a gap between with the retainer 215 and the packing element 212 and maintaining the seal in the wellbore. As an example, the further compression may result in the distance between the retainer 215 and the end ring being eight inches.

In addition, the movement of the retainer in direction 205 to maintain contact with the packing element 212 while the packing element 212 is in the second compressed state can cause a ratcheting of the ratchet mechanism 226. So, even if the downhole conditions change, the ratchet mechanism 226 prevents to the first cylinder 222 and the second cylinder 214 from moving in direction 207. Thus, the retainer 215 can hold the packing element 212 in the second compressed state. At some point in time the downhole conditions may cause the packing element 212 to even further compress beyond the second compressed state. At that point in time, the force from a further expansion of the spring 218 can cause the second piston 216, the interfacing element 228, the first cylinder 222, the second cylinder 214, and the retainer 215 to move in direction 205 and maintain contact with the packing element 212, thus catching up with the packing element 212.

Figure 4A:
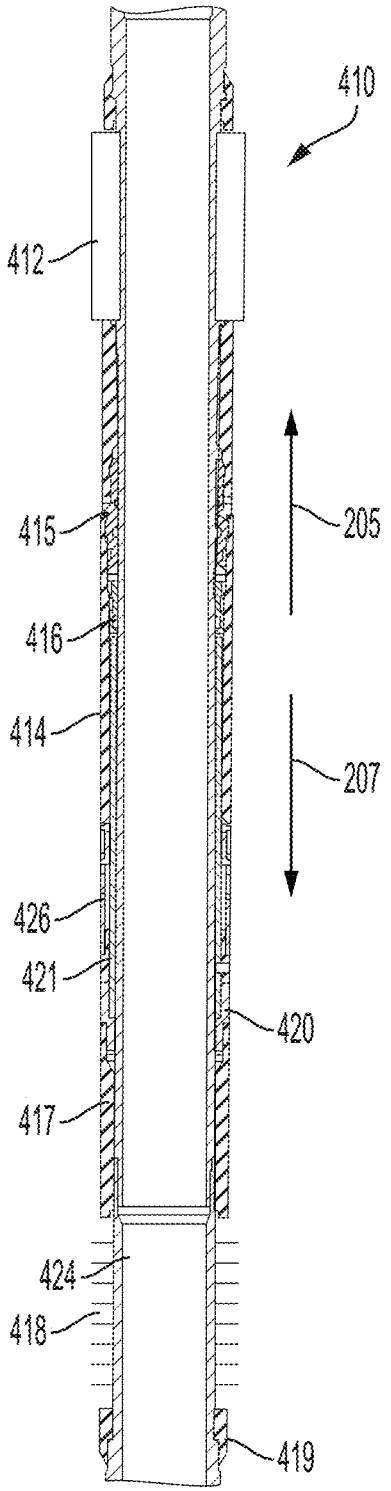
FIGS. 4A-4B are cross-sectional views of another example of a packer system with a spring and a ratchet mechanism in a run configuration and a set configuration according to one example of the present disclosure.
Figure 4B:
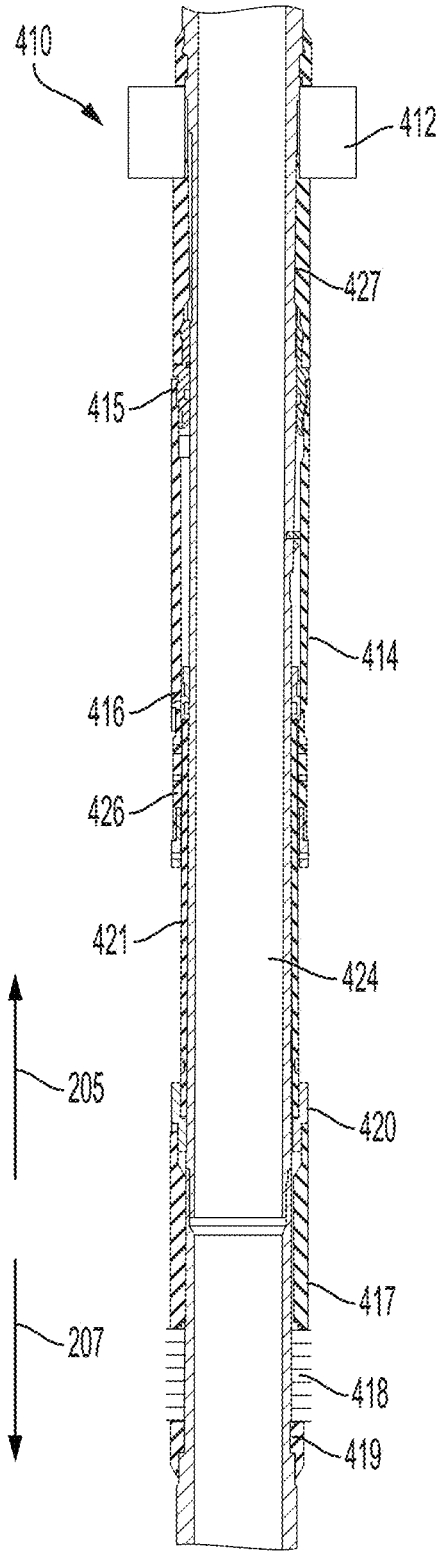

FIGS. 4A-4B are cross-sectional views of another example of a packer system 410 in a run configuration and a set configuration according to one example of the present disclosure. The packer system 410 can include a mandrel 424 that can be positioned within a wellbore. A wellbore packer can include a first retainer 415 adjacent to a packing element 412 (or a slip). The first retainer 415 can be coupled to a cylinder 414 and may move in direction 205 to compress the packing element 412 in response to an applied pressure while making a ratchet mechanism 426 of the wellbore packer ratchet. The wellbore packer can also include a piston 416 adjacent to the ratchet mechanism 426. The piston 416 can move in direction 207 in response to the applied pressure to disengage an anti-preset mechanism and compress a spring 418 that is positioned between a second retainer 417 and a third retainer 419.

Once the setting sequence is complete, the spring 418 may try to expand back to its original state. As the spring 418 attempts to expand, a spring force can be transferred into the second retainer 417, which in turn transmits the spring force into an adapter 420, a piston mandrel 421, the ratchet mechanism 426, the cylinder 414, and into the first retainer 415, which in turn transmits the force into the packing element 412. As a result, should the packing element 412 relax due to cooling or move to a second compressed state due to pressure thereby creating slack in the system, the spring force can move first retainer 415 and keep the packing element 412 compressed. The additional compression can be locked in to ensure sufficient sealing of the packing element 412 by a secondary ratcheting mechanism 427.

Figure 5:
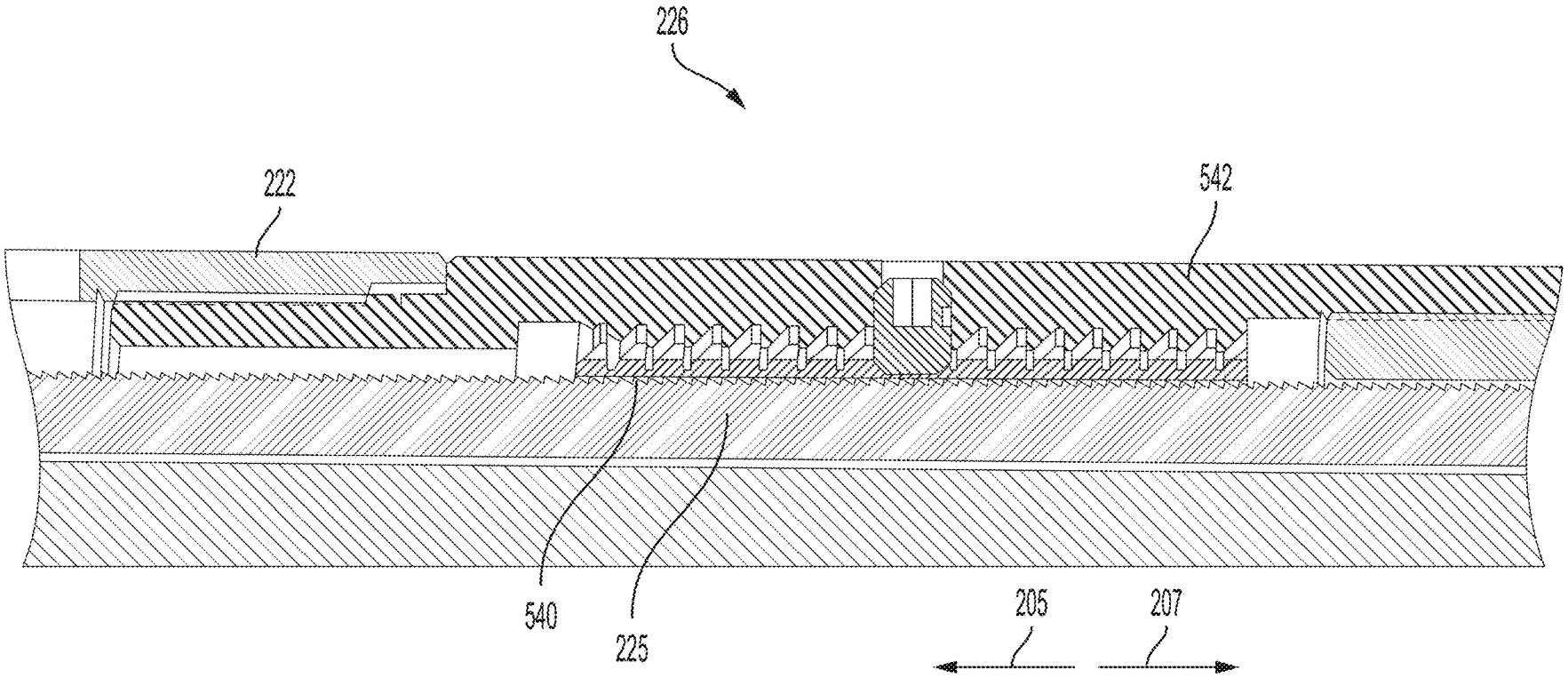
FIG. 5 is a cross-sectional view of a ratchet mechanism of a packer system according to one example of the present disclosure.

FIG. 5 is a cross-sectional view of a ratchet mechanism of a packer system according to one example of the present disclosure. The ratchet mechanism 226 (or ratchet mechanism 426) coupled to an intermediate mandrel 225 can include a lock ring 540 that can engage with a lock ring housing 542. The lock ring housing 542 can be coupled to the first cylinder 222. Teeth of the lock ring 540 can have a smaller angle on one side than on another side. For example, a side of the teeth closer to the first cylinder 222 can have a smaller angle than a side of the teeth farther from the first cylinder 222. As one particular example, the angle on the side closer to the first cylinder 222 may be 5° and the angle on the side farther from the first cylinder 222 may be 45°. Thus, the lock ring 440 can allow movement of the first cylinder 222 in direction 205 and prevent movement of the first cylinder 222 in direction 207.

Figure 6:
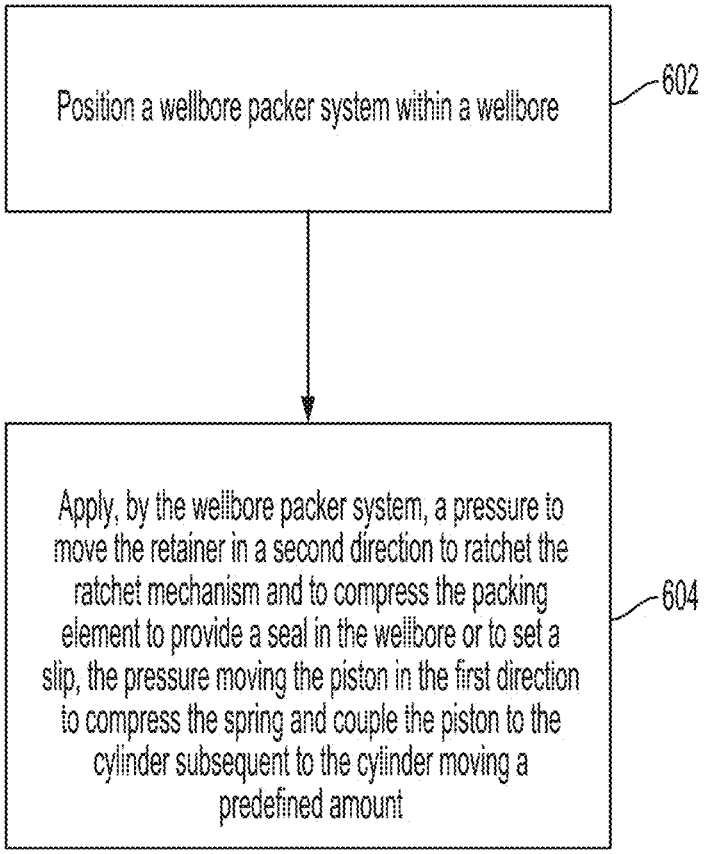
FIG. 6 is a flowchart of a process for using a packer system with a spring and a ratchet mechanism according to one example of the present disclosure.

FIG. 6 is a flowchart of a process for using a packer system with a spring and a ratchet mechanism according to one example of the present disclosure. Other examples can involve more operations, fewer operations, different operations, or a different order of the operations shown in FIG. 6. The operations of FIG. 6 are described below with reference to the components shown in FIGS. 2A-4.

At block 602, the process involves positioning a packer system 210 within a wellbore. The packer system 210 can include a retainer 215 positioned adjacent to an engaging element, such as the packing element 212 or a slip. The retainer 215 can be coupled to one or more cylinders, such as the first cylinder 222 and the second cylinder 214. The packer system 210 can also include a piston, such as the second piston 216, positioned adjacent to a spring 218. The packer system 210 can include an interfacing element 228 that can couple the second piston 216 to the first cylinder 222 and the second cylinder 214. Additionally, the packer system 210 can include a ratchet mechanism 226 for preventing movement of the first cylinder 222 and the second cylinder 214 in a first direction 207, which can be a downhole direction. The packing element 212, the retainer 215, the second piston 216, the spring 218, the first cylinder 222, the second cylinder 214, the ratchet mechanism 226, and the interfacing element 228 can be positioned around a mandrel 224 of the packer system 210.

As the packer system 210 is positioned within the wellbore, the packer system 210 can be in a run configuration, so the packing element 212 can be in an extended state. Additionally, in the run configuration, an anti-preset mechanism 236 of the packer system 210 can prevent movement of the first cylinder 222 in a second direction 205, which can be an uphole direction. The spring 218 can be in an uncompressed state in the run configuration.

At block 604, the process involves applying pressure to move the retainer 215 in the second direction 205 to ratchet the ratchet mechanism 226 and to compress the packing element 212 to a compressed state to provide a seal in the wellbore or to set a slip. The pressure can also move the second piston 216 in the first direction 207 to compress the spring 218 and move the first cylinder 222 and the second cylinder 214 a predefined amount, which can couple the second piston 216 to the second cylinder 214. The compressed state of the packing element 212 can have a shorter length and a larger thickness than the extended state of the packing element 212. The pressure can be received through a first port 232 of the mandrel 224 that is positioned between the retainer 215 and the second piston 216. The pressure can also be received through a second port 234 of the mandrel 224 that is positioned between the second piston 216 and the ratchet mechanism 226. The pressure from the second port 234 can disengage the anti-preset mechanism 236, allowing the first cylinder 222 and the second cylinder 214 to begin moving in the second direction 205.

The retainer 215 can move in the second direction 205 as the second piston 216 moves in the first direction 207 to compress the spring 218. Once the first cylinder 222 moves the predefined amount, the interfacing element 228 can couple the second cylinder 214 to the second piston 216. As a result, if the packing element 212 compresses beyond the compressed state, a spring force of the spring 218 can cause the first cylinder 222, the second cylinder 214, and the retainer 215 to move in the second direction 205 to maintain contact with the packing element 212 and the seal of the wellbore. In addition, as the retainer 215, the first cylinder 222, and the second cylinder 214 move in the second direction 205, the ratchet mechanism 226 can ratchet, preventing any backward movement of the first cylinder 222 and the second cylinder 214 in the first direction 207.

In some aspects, an apparatus, a method, and a wellbore packer system for a packer system with a spring and a ratchet mechanism for wellbore operations are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is an apparatus comprising: a retainer positionable adjacent to a packing element and coupleable to a cylinder of a downhole tool in a wellbore, the retainer being moveable in a first direction along a mandrel of the downhole tool to compress the packing element to a compressed state and generate a seal in the wellbore or to set a slip in response to an applied pressure; a piston moveable in a second direction along the mandrel and configured to compress a spring in response to the applied pressure; an interfacing element configured to couple the cylinder to the piston subsequent to the cylinder moving a predefined amount; and a ratchet mechanism configured to prevent movement of the cylinder in the second direction.

Example 2 is the apparatus of example 1, further comprising: the cylinder positionable external to the mandrel; and the packing element positionable on the mandrel, the packing element being in an extended state prior to the applied pressure.

Example 3 is the apparatus of example(s) 1-2, wherein the compressed state is a first compressed state and the packing element is compressible to a second compressed state in response to downhole conditions, wherein the cylinder, the retainer, and the piston are moveable in the first direction in response to the packing element compressing to the second compressed state.

Example 4 is the apparatus of example(s) 1-3, wherein the cylinder, the retainer, and the piston are moveable in the first direction by an expansion of the spring.

Example 5 is the apparatus of example(s) 1-4, wherein the cylinder, the retainer, and the piston moving in the first direction is configured to cause a ratcheting of the ratchet mechanism.

Example 6 is the apparatus of example(s) 1-5, wherein the interfacing element comprises a snap ring configured to engage with at least one groove of the cylinder.

Example 7 is the apparatus of example(s) 1-6, further comprising: a first port positionable between the retainer and the piston, the first port configured to receive the applied pressure; and a second port positionable between the piston and the ratchet mechanism, the second port configured to receive the applied pressure.

Example 8 is the apparatus of example(s) 1-7, further comprising: an anti-preset mechanism positionable between the second port and the ratchet mechanism, the anti-preset mechanism configured to prevent movement of the cylinder in the first direction prior to receiving the applied pressure.

Example 9 is a method comprising: positioning a wellbore packer system within a wellbore, the wellbore packer system comprising: a retainer positionable adjacent to a packing element and coupleable to a cylinder; a piston positionable adjacent to a spring; an interfacing element configured to couple the piston to the cylinder; and a ratchet mechanism configured to prevent movement of the cylinder in a first direction; and applying, by the wellbore packer system, a pressure to move the retainer in a second direction to ratchet the ratchet mechanism and to compress the packing element to a compressed state to provide a seal in the wellbore or to set a slip, the pressure moving the piston in the first direction to compress the spring and couple the piston to the cylinder subsequent to the cylinder moving a predefined amount.

Example 10 is the method of example 9, wherein the compressed state is a first compressed state, and further comprising: subsequent to the cylinder being coupled to the piston: compressing the packing element to a second compressed state in response to downhole conditions of the wellbore; and in response to compressing the packing element to the second compressed state, moving the cylinder, the retainer, and the piston in the second direction to maintain contact with the packing element and the seal in the wellbore.

Example 11 is the method of example(s) 9-10, wherein moving the cylinder, the retainer, and the piston in the second direction comprises an expansion of the spring.

Example 12 is the method of example(s) 9-11, further comprising causing a ratcheting of the ratchet mechanism by moving the cylinder, the retainer, and the piston in the second direction.

Example 13 is the method of example(s) 9-12, wherein the interfacing element comprises a snap ring configured to engage with at least one groove of the cylinder.

Example 14 is the method of example(s) 9-13, wherein the wellbore packer system further comprises: a first port for receiving the pressure, the first port positionable between the retainer and the piston; and a second port for receiving the pressure, the second port positionable between the piston and the ratchet mechanism.

Example 15 is the method of example(s) 9-14, wherein the wellbore packer system further comprises: an anti-preset mechanism positionable between the second port and the ratchet mechanism, the anti-preset mechanism configured to prevent movement of the cylinder in the second direction prior to receiving the pressure.

Example 16 is a wellbore packer system comprising: a mandrel positionable within a wellbore; and a wellbore packer positionable around the mandrel, the wellbore packer comprising: a retainer positionable adjacent to a packing element or a slip and coupleable to a cylinder, the retainer being moveable in a first direction along the mandrel to compress the packing element to a compressed state and generate a seal in the wellbore or to position the slip in an engaged state in response to an applied pressure; a piston positionable adjacent to a ratchet mechanism, the piston being moveable in a second direction along the mandrel and configured to compress a spring in response to the applied pressure; the ratchet mechanism positionable between the piston and the spring configured to prevent movement of the cylinder in the second direction; and the spring positionable adjacent to the ratchet mechanism.

Example 17 is the wellbore packer system of example 16, wherein the compressed state is a first compressed state and the packing element is compressible to a second compressed state in response to downhole conditions, wherein the cylinder, the retainer, and the piston are moveable in the first direction in response to the packing element compressing to the second compressed state.

Example 18 is the wellbore packer system of example(s) 16-17, wherein the cylinder, the retainer, and the piston are configured to move in the first direction by an expansion of the spring.

Example 19 is the wellbore packer system of example(s) 16-18, wherein the cylinder, the retainer, and the piston moving in the first direction is configured to cause a ratcheting of the ratchet mechanism.

Example 20 is the wellbore packer system of example(s) 16-19, wherein the retainer is a first retainer and the spring is positionable between a second retainer and a third retainer.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An apparatus comprising:

a retainer positionable adjacent to a packing element and coupleable to a cylinder of a downhole tool in a wellbore, the retainer being moveable in a first direction along a mandrel of the downhole tool to compress the packing element to a compressed state and generate a seal in the wellbore or to set a slip in response to an applied pressure;

a piston moveable in a second direction along the mandrel and configured to compress a spring in response to the applied pressure;

a first port positionable between the retainer and the piston, the first port configured to receive the applied pressure;

an interfacing element configured to couple the cylinder to the piston subsequent to the cylinder moving a predefined amount; and a ratchet mechanism configured to prevent movement of the cylinder in the second direction, an expansion of the spring being configured to cause a ratcheting of the ratchet mechanism for the retainer to maintain the seal in the wellbore.

2. The apparatus of claim 1, further comprising:

the cylinder positionable external to the mandrel; and the packing element positionable on the mandrel, the packing element being in an extended state prior to the applied pressure.

3. The apparatus of claim 1, wherein the compressed state is a first compressed state and the packing element is compressible to a second compressed state in response to downhole conditions, wherein the cylinder, the retainer, and the piston are moveable in the first direction in response to the packing element compressing to the second compressed state.

4. The apparatus of claim 3, wherein the cylinder, the retainer, and the piston are moveable in the first direction by the expansion of the spring.

5. The apparatus of claim 3, wherein the cylinder, the retainer, and the piston moving in the first direction is further configured to cause the ratcheting of the ratchet mechanism.

6. The apparatus of claim 1, wherein the interfacing element comprises a snap ring configured to engage with at least one groove of the cylinder.

7. The apparatus of claim 1, further comprising:

a second port positionable between the piston and the ratchet mechanism, the second port configured to receive the applied pressure.

8. The apparatus of claim 7, further comprising:

an anti-preset mechanism positionable between the second port and the ratchet mechanism, the anti-preset mechanism configured to prevent movement of the cylinder in the first direction prior to receiving the applied pressure.

9. A method comprising:

positioning a wellbore packer system within a wellbore, the wellbore packer system comprising:

a retainer positionable adjacent to a packing element and coupleable to a cylinder;

a piston positionable adjacent to a spring;

a first port for receiving a pressure positionable between the retainer and the piston;

an interfacing element configured to couple the piston to the cylinder; and a ratchet mechanism configured to prevent movement of the cylinder in a first direction; and applying, by the wellbore packer system, the pressure to move the retainer in a second direction to ratchet the ratchet mechanism and to compress the packing element to a compressed state to provide a seal in the wellbore or to set a slip, the pressure moving the piston in the first direction to compress the spring and couple the piston to the cylinder subsequent to the cylinder moving a predefined amount, an expansion of the spring being configured to cause a ratcheting of the ratchet mechanism for the retainer to maintain the seal in the wellbore.

10. The method of claim 9, wherein the compressed state is a first compressed state, and further comprising:

subsequent to the cylinder being coupled to the piston:

compressing the packing element to a second compressed state in response to downhole conditions of the wellbore; and in response to compressing the packing element to the second compressed state, moving the cylinder, the retainer, and the piston in the second direction to maintain contact with the packing element and the seal in the wellbore.

11. The method of claim 10, wherein moving the cylinder, the retainer, and the piston in the second direction comprises the expansion of the spring.

12. The method of claim 10, further comprising causing the ratcheting of the ratchet mechanism by moving the cylinder, the retainer, and the piston in the second direction.

13. The method of claim 9, wherein the interfacing element comprises a snap ring configured to engage with at least one groove of the cylinder.

14. The method of claim 9, wherein the wellbore packer system further comprises:

a second port for receiving the pressure, the second port positionable between the piston and the ratchet mechanism.

15. The method of claim 14, wherein the wellbore packer system further comprises:

an anti-preset mechanism positionable between the second port and the ratchet mechanism, the anti-preset mechanism configured to prevent movement of the cylinder in the second direction prior to receiving the pressure.

16. A wellbore packer system comprising:

a mandrel positionable within a wellbore; and a wellbore packer positionable around the mandrel, the wellbore packer comprising:

a retainer positionable adjacent to a packing element or a slip and coupleable to a cylinder, the retainer being moveable in a first direction along the mandrel to compress the packing element to a compressed state and generate a seal in the wellbore or to position the slip in an engaged state in response to an applied pressure;

a piston positionable adjacent to a ratchet mechanism, the piston being moveable in a second direction along the mandrel and configured to compress a spring in response to the applied pressure;

the ratchet mechanism positionable between the piston and the spring configured to prevent movement of the cylinder in the second direction; and the spring positionable adjacent to the ratchet mechanism, an expansion of the spring being configured to cause a ratcheting of the ratchet mechanism for the retainer to maintain the seal in the wellbore.

17. The wellbore packer system of claim 16, wherein the compressed state is a first compressed state and the packing element is compressible to a second compressed state in response to downhole conditions, wherein the cylinder, the retainer, and the piston are moveable in the first direction in response to the packing element compressing to the second compressed state.

18. The wellbore packer system of claim 17, wherein the cylinder, the retainer, and the piston are configured to move in the first direction by the expansion of the spring.

19. The wellbore packer system of claim 17, wherein the cylinder, the retainer, and the piston moving in the first direction is further configured to cause the ratcheting of the ratchet mechanism.

20. The wellbore packer system of claim 16, wherein the retainer is a first retainer and the spring is positionable between a second retainer and a third retainer.

* * * * *